United States Patent [19]

David

[11] Patent Number: 5,046,274

[45] Date of Patent: Sep. 10, 1991

[54] BANNER DISPLAY APPARATUS

[76] Inventor: Henry B. David, 4420 San Fernando Rd., Glendale, Calif. 91204

[21] Appl. No.: 503,782

[22] Filed: Apr. 3, 1990

[51] Int. Cl.[5] ..... G09F 17/00

[52] U.S. Cl. ..... 40/604; 40/502; 40/493

[58] Field of Search ..... 40/473, 493, 502, 506, 40/574, 603, 604

[56] References Cited

U.S. PATENT DOCUMENTS

| | | | |
|---|---|---|---|
| 1,045,642 | 11/1912 | Torrey | 40/502 |
| 1,509,125 | 9/1924 | Burbank | 40/493 |
| 1,915,236 | 6/1933 | Messner | 40/502 |
| 1,930,048 | 10/1933 | Harding | 40/502 |
| 2,075,245 | 3/1937 | Van Schuck | 40/473 |
| 3,313,165 | 4/1967 | Evans | 40/502 |
| 3,947,987 | 4/1976 | Allen | 40/506 |
| 4,318,237 | 3/1982 | Hicks | 40/502 |
| 4,580,361 | 4/1986 | Hillstrom | 40/603 |
| 4,910,897 | 3/1990 | Hsu | 40/473 |

FOREIGN PATENT DOCUMENTS

| | | | |
|---|---|---|---|
| 193192 | 9/1937 | Switzerland | 40/502 |
| 127655 | 9/1938 | Switzerland | 40/502 |

*Primary Examiner*—Gary L. Smith
*Assistant Examiner*—F. Saether
*Attorney, Agent, or Firm*—Michael A. Painter

[57] ABSTRACT

An apparatus for mounting and displaying banners or like non-rigid media. The display apparatus employs at least three display frames which are rotatable about an illuminated central axis of rotation. Each of the display frames comprises a structure for mounting banners or other non-rigid display media formed to be received within the display frames. Receiving apertures are uniformly disposed about each display frame. The media to be displayed is stretched across the frame and secured to the receiving apertures in a manner which will place the banner under uniform tension across its entire surface. Each supporting element of the display frames is coupled to an independently pivoting cover member having a width sufficient to extend beyond and obscure the receiving apertures from view.

2 Claims, 2 Drawing Sheets

FIG. 1
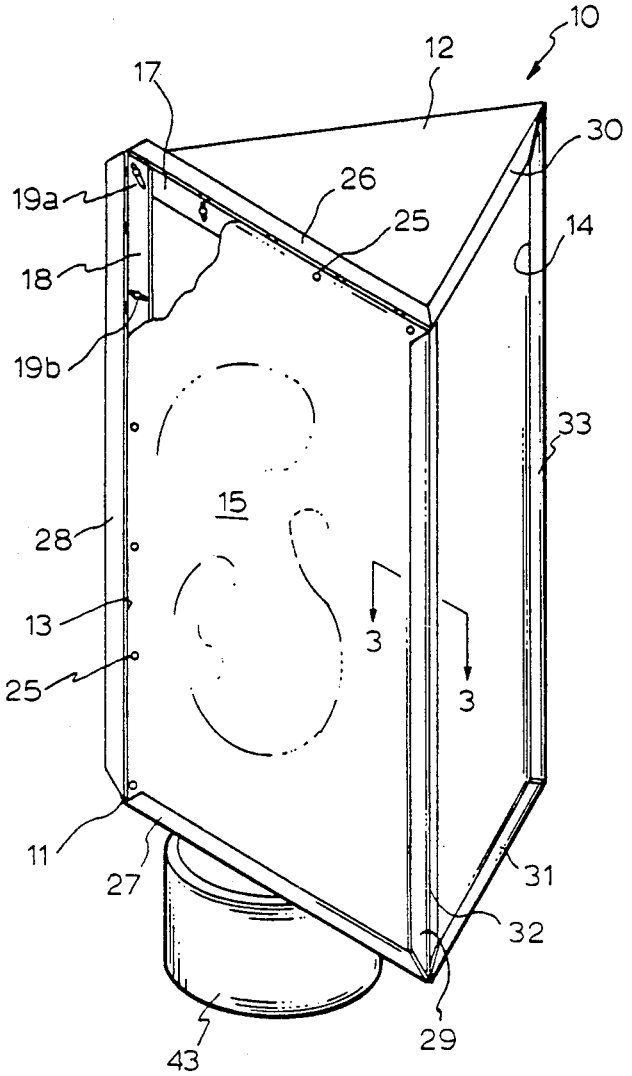
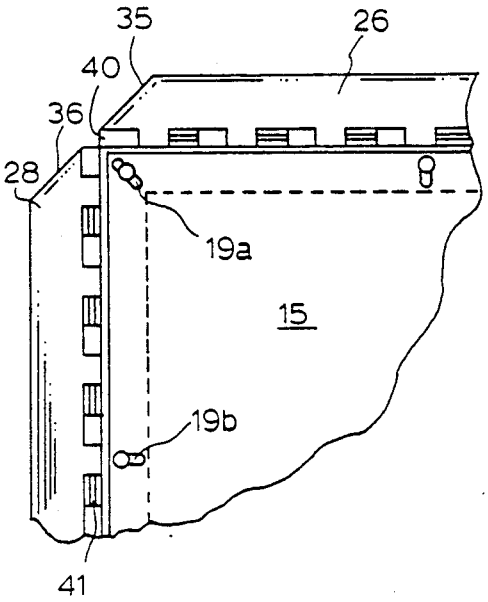
FIG. 2
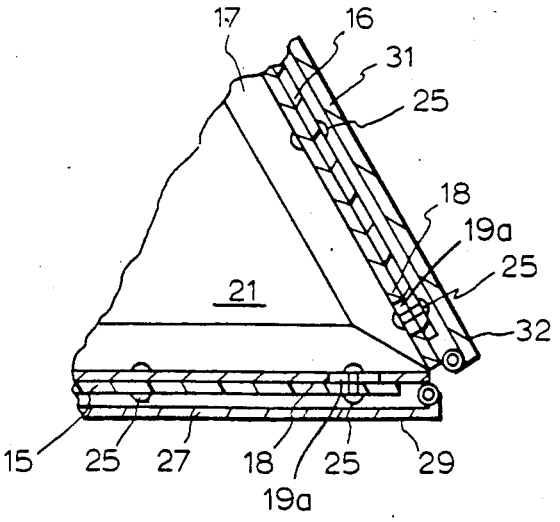
FIG. 3

FIG. 4
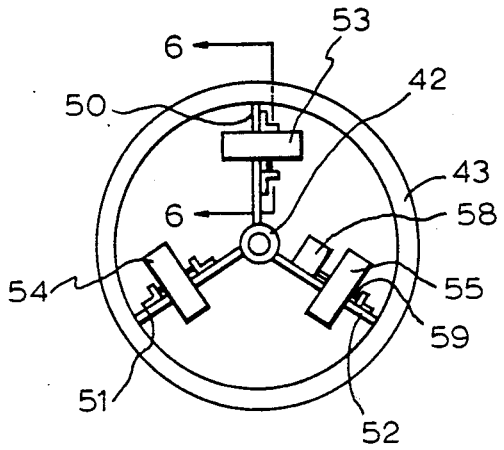
FIG. 5
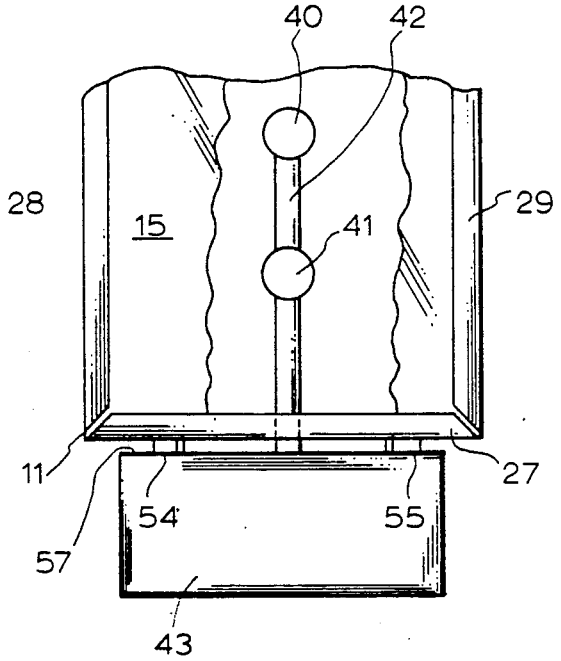
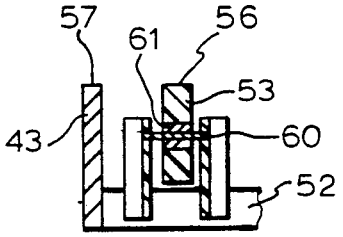
FIG. 6

BANNER DISPLAY APPARATUS

BACKGROUND OF THE INVENTION

1. Field of the Invention

The present invention generally relates to illuminated display units and more particularly to apparatus used to display non-rigid indicia bearing media.

2. Prior Art

The prior art discloses numerous examples of illuminated display apparatus used for varying categories of indicia bearing media. The typical device disclosed by the prior art employs a multi-faced drum, each face being adapted to mount cards or other rigid objects. Some of these devices utilize rotating power sources for rotating the drum. Use of an illuminated interior cavity is also disclosed. In general, these types of devices can be employed only to display rigid media which must be mounted directly upon or to the display face.

Another device taught by the prior art is used to illuminate and display photographs printed on translucent paper. Since the media upon which the photographs are printed has limited rigidity, the photograph can be placed between two transparent panels and mounted within the display frame. The problems inherent in attempting to mount media having no structural rigidity are obvious. Banners made of cloth, tissue paper or other media lacking structural rigidity can be displayed only if the surface thereof is placed under sufficient tension to eliminate folds or other sources of optical distortion.

The present invention resolves the problems inherent in those devices disclosed in the prior art. The present invention specifically provides the ability to illuminate and display translucent media having little if any structural rigidity. To effectively display non-rigid indicia bearing media, it is necessary to place the surface of the media under tension to remove folds or other causes of visual distortion. In the present invention, a display drum comprising at least three display panels rotates about a source of illumination. The media to be displayed is stretched across a display panel and securely coupled to the structure of the display frame in a manner which will place the displayed media under uniform tension. Each supporting element of the display frames has pivotally coupled thereto an independent covering member which visually obscures the means used to secure the indicia bearing media to the display frame.

SUMMARY OF THE INVENTION

The present invention constitutes an illuminated, rotating display apparatus adapted specifically for displaying indicia bearing media lacking structural rigidity such as cloth banners, tissue paper and the like. A display drum comprises at least three rectangular display frames interfaced along adjacent edges and rotatable about its vertical axis of rotation. The display drum is coupled to a rotary base. The interior cavity of the display drum is illuminated for the purpose of displaying mounted indicia bearing media.

Each display frame defines a plurality of receiving apertures to which the indicia bearing media is to be coupled. In order to properly mount the indicia bearing member for display, it must be placed under uniform tension in order to remove all folds or other sources of visual distortion. Each vertical and horizontal member of a display frame has coupled thereto an independently pivotable cover which, when closed, obscures the means used to couple the displayed item from view.

It is therefore an object of the present invention to provide an improved, illuminated, rotating display apparatus for banners and the like.

It is another object of the present invention to provide a display apparatus which can be used for indicia bearing media lacking structural rigidity.

It is yet another object of the present invention to provide a display apparatus which includes means for imposing uniform tension on indicia bearing media to remove sources of visual distortion.

It is still yet another object of the present invention to provide a banner display apparatus which is inexpensive and simple to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

BRIEF DESCRIPTION OF THE DRAWING

FIG. 1 is a perspective view of a banner display apparatus in accordance with the present invention.

FIG. 2 is a partial, front plan view of the present invention illustrating a mounted banner.

FIG. 3 is a partial, cross-sectional view of the present invention banner display apparatus taken through line 3—3 of FIG. 1.

FIG. 4 is a top plan view of the rotary base illustrated in FIG. 1.

FIG. 5 is a partial, front plan view of the rotary base and display drum illustrating the interior cavity thereof.

FIG. 6 is a cross-sectional view of the display apparatus base taken through line 6—6 of FIG. 4.

DESCRIPTION OF THE PRESENTLY PREFERRED EMBODIMENT

An understanding of the present invention can be best gained by reference to the drawings wherein the present invention banner display apparatus is generally referred to by the reference numeral 10. FIG. 1 illustrates a perspective view of the apparatus 10. The preferred embodiment of the invention illustrated in FIG. 1 comprises a trilateral display drum 11 having an opaque top wall 12 and three vertically oriented, rectangular display frames uniformly mounted about the vertical axis of rotation. The two display frames which can be seen in FIG. 1 are designated by the reference numerals 13 and 14.

As set forth hereinabove, an object of the present invention is to provide means for mounting indicia bearing media totally lacking in structural rigidity. Indicia bearing media of the type used for the present invention comprise banners constructed of cloth, tissue paper or the like. As can be seen in FIG. 1, banner 15 is secured within display frame 13, banner 16 being secured within display frame 14. It is an object of the present invention to mount banners in a manner which eliminates substantially all causes of visual distortion. To properly mount the banners 15 and 16, the structure of display frames 13 and 14 provide for means to place banners 15 and 16 under uniform tension thereby fully stretching the banner across the upper and lower horizontal supports 17 and the parallel vertical supports 18 forming each of the display frames 13 and 14.

Each of the display frames 15 and 16 are rectangular structures formed by upper and lower horizontal supports 17 and engaged parallel vertical supports 18. As can be best seen in FIG. 3, horizontal supports 17 comprise L-shaped flanges which are adjacent to one another at apex 21 formed by the interface between each pair of adjacent display frames. The rectangular aperture formed by the engagement of horizontal supports 17 and vertical supports 18 allow the mounted banners 15 and 17 to be illuminated from a light source located within the interior cavity of display drum 11 (see FIG. 5), a subject which will be discussed in detail hereinbelow.

As stated, a primary object of the present invention is to provide means to mount the non-rigid banners in a manner which will eliminate the causes of visual distortion. As shown in FIG. 1, each vertical support 18 is provided with a plurality of receiving apertures 19 spaced equidistant along the length of vertical support 18. In a like manner, upper and lower horizontal supports 17 are provided with receiving apertures 20 spaced equidistant along the length of support members 17. It is understood that the number of receiving apertures shown in FIG. 1 is for the purpose of example only, the number to be used being sufficient to insure the mounted banners 15 and 16 are fully stretched across the respective display frames 13 and 14 placing the banner under uniform tension.

The coupling of banners 15 and 16 within display frames 13 and 14, respectively, can be best seen by reference to FIG. 2 and FIG. 3. In order to impose uniform tension upon a mounted banner, the receiving apertures 19 and 20 comprise elongated slots disposed in the respective frame supports. In receiving apertures 20 disposed in horizontal supports 17, the longitudinal axis of the elongated slots are parallel to the vertical supports 18. In receiving aperture 19a disposed at the apex 21, the longitudinal axis thereof bisects the 90° angle of engagement between the horizontal support 17 and vertical support 18. All receiving apertures **19*b* have their longitudinal axes parallel to upper and lower horizontal supports 17. Utilizing conventional couplings, the edge of the banner is coupled to the horizontal and vertical support by engaging the appropriate receiving aperture and, utilizing the length of the longitudinal slot, the coupling is moved outwardly to fully stretch the mounted banner. It is understood that, by appropriately locating the mounting location on the banners, they can be mounted through the use of conventional flat head rivets disposed through a circular receiving apertures 19*a*, 19*b* and 20**.

In order to provide a visually acceptable display, the heads 25 of the couplings used to mount the banners must be covered or otherwise obscured from view. As can be best seen in FIG. 1, each display frame 13 and 14 is provided with an independently, pivotable cover along each of the supporting members making up the display frame. In FIG. 1, upper and lower horizontal supports 17 of display frame 13 are hinged to covering members 26 and 27, respectively, vertical supports 18 being hinged to covering members 28 and 29, respectively. In a like manner, display frame 14 is provided with corresponding horizontal cover members 30 and 31 and vertical cover members 32 and 33. As shown in FIG. 1, cover members 26 and 28 are illustrated in the open position exposing the heads 25 of the means used to couple the banner 15 to supports 17 and 18.

The interface between the cover members and the display frames is best seen by reference to FIG. 2 and FIG. 3. As shown in FIG. 2, cover member 26 is pivotally coupled to upper horizontal supports 17 through a conventional hinge 40. In a like manner, cover member 28 is pivotally coupled to vertical support 18 through conventional hinge 41. In order to provide a display apparatus which is aesthetically acceptable, covers 26 and 28 are beveled at the ends 35 and 36 thereof, and provide the appearance of an integral frame when rotated about hinges 40 and 41 in position to cover coupling heads 25. FIG. 3 illustrates a partial, cross-sectional view of the apex 19 at the interface between display frames 13 and 14. As can be seen, in the closed position, covering members 32 and 29 obscure the heads 25 of the coupling means and lie in the same plane as closed covering members 31 and 27, respectively.

A primary objective of the present invention is to provide an illuminated display for translucent banners. FIG. 5 represents a schematic view of the interior cavity of display drum 11 exposing light sources 40 and 41 which provide illumination along the full vertical height of banner 15. Illuminating sources 40 and 41 are supported by conventional sockets and conduit 42, the latter to be secured within, and extending from, the structure of base 43.

A primary objective of the present invention is to provide an illuminated display for mounted banners which are rotatable about their vertical axis of rotation. As can be seen in FIG. 4, base 43 is a substantially cylindrical structure which is trisected by radial support arms 50, 51 and 52, each of which depends outwardly from conduit 42. Each of the support arms 50, 51 and 52 provide the supporting base for wheels 53, 54 and 55, respectively. As can be seen in FIG. 6, the upper surface 56 of wheel 53 extends vertically above the upper wall 57 of base 43. Wheel 55 is driven by a conventional electric motor 58 which rotates a suitable journeled shaft 59. Wheels 51 and 53 comprise idler wheels. As shown in FIG. 6, wheel 53 is suitable journeled upon shaft 60 by conventional bearings 61 or the like.

The lower wall (not shown) of display drum 11 is parallel to top wall 12 and engages the upper circumferential surface 56 of wheels 53, 54 and 55. The lower surface of display drum 11 is suitably journeled about conduit 42 at the vertical axis of display drum 11. When motor 58 is activated, wheel 55 will rotate thereby transmitting its motion to the lower wall of display drum 11. Idler wheels 53 and 54 facilitate the rotation of display drum 11 maintaining its stable orientation as it rotates about its vertical axis of rotation.

We claim:

1. A banner display apparatus comprising:

(a) a display enclosure having three rectangular display frames each including an upper and lower horizontal support and a pair of parallel vertical supports, each vertical support being adjacent a vertical support of an adjacent display frame forming a trilateral polyhendron, the vertical supports of each display frame intersecting the horizontal supports of said display frame at each apex thereof, each vertical support where intersecting a horizontal support, has disposed therethrough an elongated aperture extending along an axis bisecting the angle between the intersecting horizontal and vertical supports and further including a plurality of aligned elongated aperatures disposed therethrough, each extending along an axis which is parallel to said horizontal supports, each horizontal support having disposed therethrough a plurality of aligned elongated apertures disposed therethrough, each extending along an axis parallel to the vertical supports;

(b) a stationary base comprising a cylindrical wall and including an elongated conduit coupled within said cylinder along the axis thereof and extending upwardly therefrom, said display enclosure being coupled to said conduit along its vertical axis of rotation;

(c) rotation means for supporting and rotating said display enclosure, said rotation means being coupled within the cylindrical wall of said stationary base;

(d) a light source coupled to the conduit within said display enclosure;

(e) means for securing a banner at each of the elongated apertures disposed in the horizontal and vertical supports of each display frame placing the banners under uniform tension whereby the banner is mounted without folds or other causes of visual distortion; and (f) covering members pivotally coupled to each of the horizontal and vertical supports, each adapted to be rotated and placed adjacent the coupling between the banner and said horizontal and vertical supports.

2. A banner display as defined in claim 1 wherein said rotation means comprises:

(a) a rotary power source;

(b) a first wheel coupled to said rotary power source, the axis of rotation of said first wheel being aligned with the radius of said cylinder, the surface of said first wheel extending above said cylinder wall; and (c) second and third wheels coupled within said cylinder, the axis of rotation of said second and third wheels being aligned along the radius of said cylinder, the axis of rotation of said first, second and third wheels trisecting said cylinder, the surface of said second and third wheels extending above the cylinder wall to the same height as the surface of said first wheel whereby the bottom wall of said display enclosure is in contact with and rotates upon the surfaces of said first, second and third wheels.

* * * * *